US005149906A

United States Patent [19]

August

[11] Patent Number: 5,149,906

[45] Date of Patent: Sep. 22, 1992

[54] TECHNIQUE FOR LAUNCHING A PROJECTILE INTO A FLOWING MEDIUM

[75] Inventor: Henry August, Chatsworth, Calif.

[73] Assignee: Hughes Aircraft Company, Los Angeles, Calif.

[21] Appl. No.: 716,166

[22] Filed: Jun. 17, 1991

[51] Int. Cl.[5] ..... F41F 3/07

[52] U.S. Cl. ..... 89/1.810; 89/1.809; 89/1.816

[58] Field of Search ..... 89/1.809, 1.810, 1.812, 89/1.815, 1.816

[56] References Cited

U.S. PATENT DOCUMENTS

| | | | |
|---|---|---|---|
| 2,802,399 | 8/1957 | Little | 89/1.816 |
| 2,998,754 | 9/1961 | Bialy | 89/1.816 |
| 3,075,301 | 1/1963 | Fiedler et al. | 89/1.810 |
| 3,892,194 | 7/1975 | Goedde et al. | 89/1.809 |
| 4,173,919 | 11/1979 | Piesik | 89/1.816 |
| 4,934,241 | 6/1990 | Piesik | 89/1.816 |

*Primary Examiner*—David H. Brown

*Attorney, Agent, or Firm*—C.D. Brown; R. M. Heald; W. K. Denson-Low

[57] ABSTRACT

A technique for reducing the lateral force exerted upon a projectile launched into a flowing medium. The inventive technique includes the step of injecting a pressurized jet (J) into a medium (14), upstream of the launch point, flowing laterally relative to the anticipated path of a projectile (16). The projectile (16) is then propelled from a first location (18) into the medium (14) proximate the jet (J) injected therein.

8 Claims, 2 Drawing Sheets

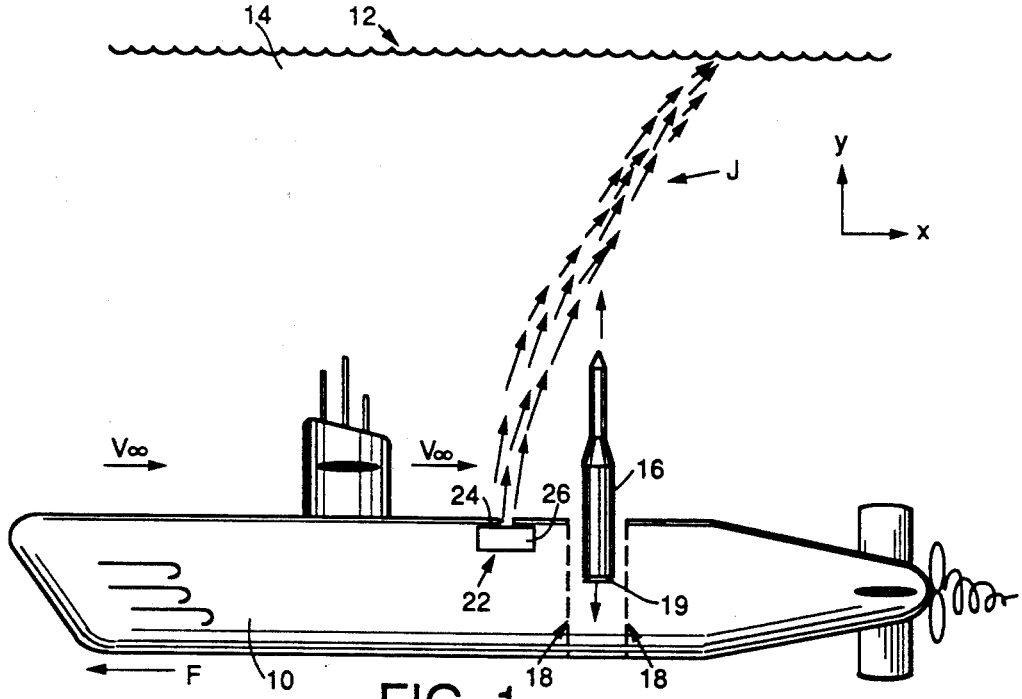
FIG. 1.
FIG. 2a.
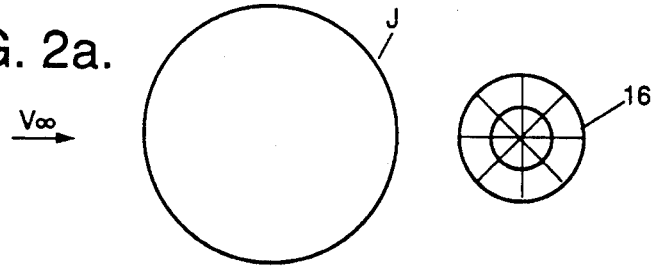
FIG. 2b.
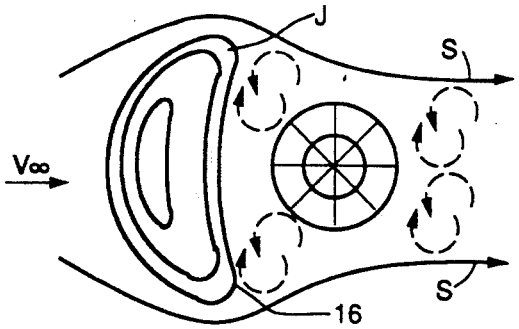
FIG. 2c.
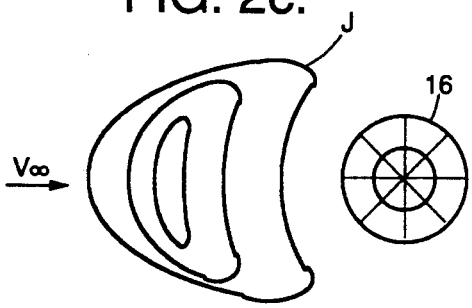

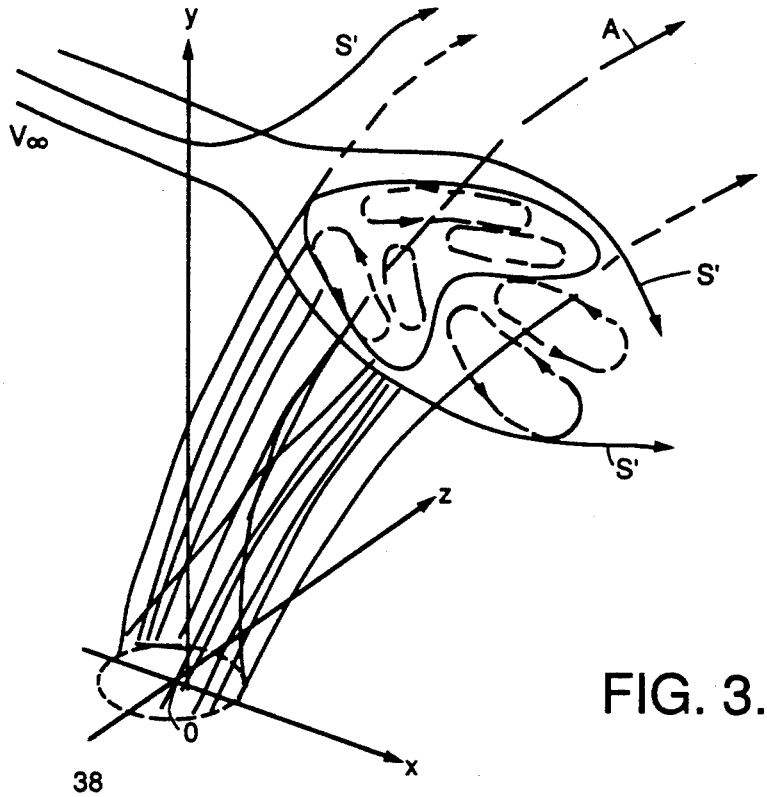
FIG. 3.
FIG. 4.
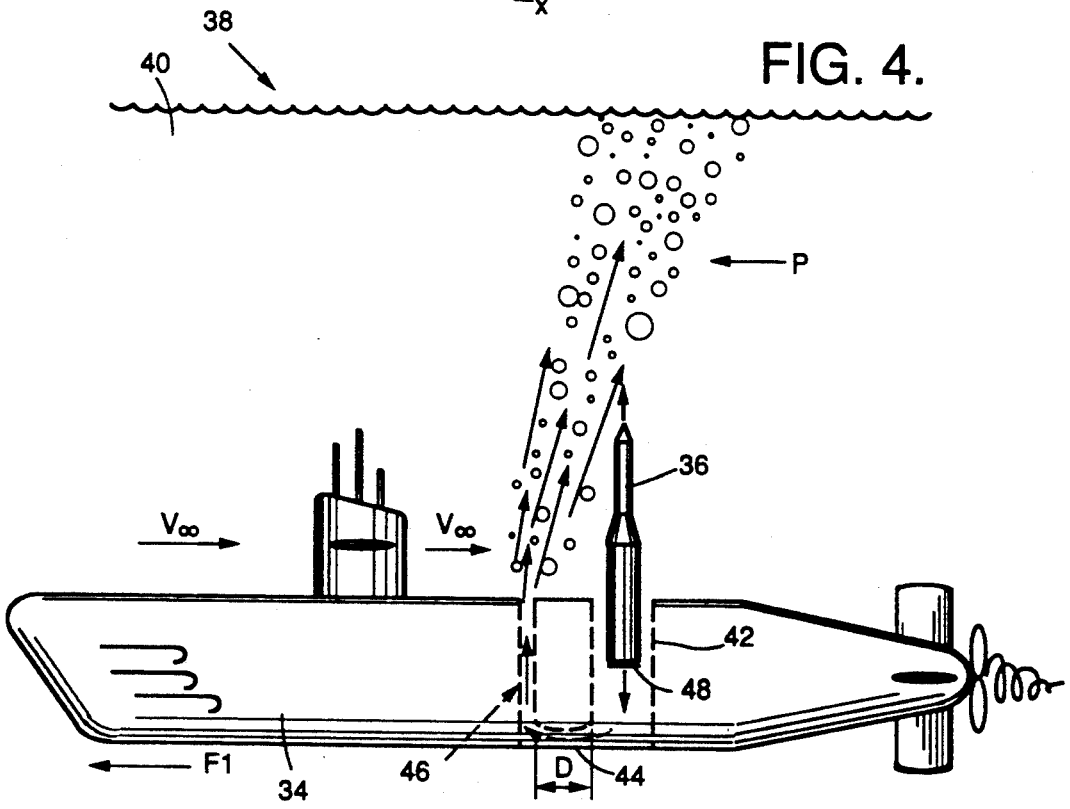

TECHNIQUE FOR LAUNCHING A PROJECTILE INTO A FLOWING MEDIUM

BACKGROUND OF THE INVENTION

1. Field of the Invention

This invention relates to methods and apparatus for launching a projectile. More specifically, this invention relates to methods and apparatus for facilitating launches of a projectile in the presence of a flowing medium.

While the present invention is described herein with reference to a particular embodiment, it is understood that the invention is not limited thereto. Those having ordinary skill in the art and access to the teachings provided herein will recognize additional embodiments within the scope thereof.

2. Description of the Related Art

As a result of motion of a submarine through water a submarine launched missile is exposed to a lateral hydrodynamic force as it emerges from the launch tube. This lateral hydrodynamic loading is proportional to the square of the forward velocity of the submarine and causes the missile to torque. Binding occurs between the partially exposed missile and the interior surfaces of the launch tube. Accordingly, submarines have been constrained to low forward velocities while launching missiles in order to reduce binding within the launch tube. Unfortunately, this phenomenon reduces the ability of a submarine to rapidly displace itself from a launch location in order to avoid detection.

Annular tube fillers have been utilized in an effort to minimize binding between the missile and launch tube. These tube fillers are inserted within the launch tube and serve to facilitate launch of the missile. Although the tube fillers reduce binding between the missile and launch tube precipitated by the torquing action of the flowing water, the submarine nonetheless remains constrained to travel at low velocities during missile launch. Moreover, annular tube fillers also reduce the maximum diameter of missiles which may launched from tubes in which such fillers are employed.

A similar binding occurs when missiles are launched from surface vessels. In particular, aerodynamic lateral forces (crossflow drag), arising from ship motion, torque missiles emerging from launch tubes which open into the crossflow. It follows that surface vessels are also typically limited to low forward velocities when launching missiles in a direction having a component normal to the direction in which the vessel is traveling. Moreover, surface winds of sufficient velocity in directions lateral to the intended initial path of the missile may also induce this undesired binding.

Accordingly, a need exists in the art for a method or apparatus for minimizing the lateral force exerted on missiles or other projectiles launched from vehicles in rapid motion within a fluid or gaseous environment.

SUMMARY OF THE INVENTION

The aforementioned need in the art for a method or apparatus for ameliorating the lateral force exerted upon a projectile launched into a medium flowing laterally relative thereto is addressed by the launching technique of the present invention. The present invention includes apparatus for injecting a pressurized jet of a gas or fluid into the medium immediately upstream relative to the path of the projectile. The projectile is then propelled from a first location into the medium proximate the jet injected therein.

BRIEF DESCRIPTION OF THE DRAWINGS

FIG. 1 is a diagram showing a side view of a submarine submerged below the surface of a surrounding body of water.

FIGS. *2a*, *2b* and *2c* show top views of a projectile and cross-sectional contours of a jet injected normal to the path of the submarine as each would exist at successively greater distances from the submarine, respectively.

FIG. 3 shows a jet stream subsequent to injection into a lateral flow field indicated by horizontal streamlines S'.

FIG. 4 is a diagram showing a side view of a submarine adapted to launch a projectile therefrom in accordance with an alternative version of the launching technique of the present invention.

DETAILED DESCRIPTION OF THE INVENTION

FIG. 1 is a diagram showing a side view of a submarine 10 submerged below the surface 12 of a surrounding body of water 14. The submarine 10 is in motion in a direction F substantially parallel to the surface 12. The submarine 10 is engaged in launching a missile or other projectile 16 into the water 14 in accordance with the launching technique of the present invention. As is described below, in the aqueous context of FIG. 1, the inventive launching technique includes the step of injecting a jet J into the water 14, upstream of the launch point, proximate the point of launch of the projectile 16. Injection of the jet J upstream of the launch point serves to substantially impede the lateral flow of water 14 relative to the submarine 10 in the vicinity of the projectile 16. In this manner the inventive launching technique significantly lessens the lateral hydrodynamic force exerted upon the projectile 16 during launch.

As is shown in FIG. 1, the projectile 16 is disposed in a launch tube 18 included within the submarine 10. The diameter of the launch tube 18 need only slightly exceed that of the projectile 16 since the technique of the present invention minimizes any binding therebetween during launch. Accordingly, utilization of the inventive launching technique allows projectiles of relatively large diameter to be launched from conventional launch tubes.

The projectile 16 may be propelled from the tube 18 with the aid of a conventional propulsion system. In particular, thrust developed through a nozzle 19 causes the projectile 16 to vertically rise within the tube 18. Alternatively, for safety reasons the projectile may be partially "floated out" of the tube 18 prior to actuation of an internal propulsion system.

FIG. 1 also depicts a pump assembly 22 operative to inject the jet J into the water 14 proximate the launch tube 18 upstream of the launch point. In the embodiment of FIG. 1 the jet J is composed of pressurized water injected through a nozzle 24 included within the pump assembly 22. It is noted that in alternative embodiments jets of compressed air or other gases may be substituted for the aqueous jet J. The nozzle 24 is in fluid communication with a compressor chamber 26. The chamber 26 is operative to supply the nozzle 24 with a source of pressurized water. The jet J is injected into the water 14 (which flows with velocity $V_\infty$ relative to the submarine 10) before the projectile 16 begins to emerge from the tube 18.

FIGS. 2*a*, 2*b* and 2*c* show top views of the projectile 16 and cross-sectional contours of the jet J existing at successively greater distances, respectively, from the submarine 10. In particular, FIG. 2*a* depicts the contours of the jet J in a cross-sectional plane close to the nozzle 24. FIGS. 2*b* and 2*c* show the jet contours at successively larger displacements from the submarine 10. Inspection of FIGS. 2*a*, 2*b* and 2*c* reveals that the jet J assumes a horseshoe-shaped contour in its cross-sections as it propagates away from the nozzle 24. Again, the jet J serves to impede the lateral flow of water relative to the projectile 16. As shown in FIG. 2*b*, the paths of horizontal streamlines S of water flowing at modified velocity deviate around the projectile 16 upon encountering the jet J. The dashed lines in FIG. 2*b* indicate a separate flow region where significantly reduced velocities occur in the vicinity of the projectile 16. Consequently, the lateral hydrodynamic loading on the emerging projectile 16 is significantly reduced at higher submarine speeds.

The behavior of jets injected into a lateral flow field (as is illustrated in FIGS. 2*a*, 2*b*, and 2*c* with respect to the jet J) has been analyzed by several scientists including, for example, Abramovich, G. N., The Theory of Turbulent Jets, pp. 541–580, The M. I. T. Press, Massachusetts (1963). See also Margason, R. J., "The Path of a Jet Directed at Large Angles to a Subsonic Free Stream," NASA Technical Note D-4919, November 1968. These references indicate the path of a jet stream injected into a uniform flow field depends primarily on two factors. These factors are (i) the injection angle of the jet stream and (ii) the ratio of dynamic pressures of the lateral flow field to the injected jet flow. The dynamic pressure of a medium corresponds to one half of the product of the density and squared velocity of the medium.

FIG. 3 shows an illustrative representation of a jet stream, such as the jet J, subsequent to being injected into a lateral flow field indicated by horizontal streamlines S'. As shown in FIG. 3, the undisturbed flow field propagates with velocity $V_\infty$ parallel to an X coordinate axis. Again, the streamlines S' of the flow field deviate from horizontal paths upon reaching the periphery of the jet stream. The jet stream of FIG. 3 originates from a circular nozzle, and follows an axis A which may be mapped in the X,Y coordinate plane in accordance with the following empirical expression proposed by Shandorov:

$$x/d=(q_{01}/q_{02})(y/d)^{2.55}+(y/d)(1+q_{01}/q_{02})\cot\alpha \quad [1]$$

where x and y are the coordinates of the axis A; d is the diameter of the nozzle; $\alpha$ is the angle between the nozzle direction and the direction of the flow field; and where $$q_{01}=\rho_1(w^2/2)$$

and $$q_{02}=\rho_2(v_0^2/2)$$

are the dynamic pressures in the flow field and in the jet's initial cross section, respectively. The initial velocity of the jet stream is represented by $v_0$, while the scalar magnitude of the velocity $V_\infty$ is given by "w". In addition, $\rho_1$ and $\rho_2$ are the densities of the flow field and jet stream media, respectively. See Shandorov, G. S., "Flow From a Channel into Stationary and Moving Media," *Zh. Tekhn. Fiz.*, 37, 1, (1957).

In the specific embodiment of FIG. 1 the jet J is injected normal to the flow of water adjacent the submarine 10. This corresponds to an injection angle $\alpha$ of ninety degrees, and thus for the case of FIG. 1 the path of the jet J reduces from equation [1] to:

$$x/d=(q_{01}/q_{02})(y/d)^{2.55} \quad [2]$$

It is observed that $q_{01}$ is proportional to the square of the velocity of the submarine 10 and $q_{02}$ is proportional to the square of the initial velocity of the jet J. Hence, for a given submarine velocity the path of the injected jet J may be altered by varying the injection velocity thereof.

FIG. 4 is a diagram showing a side view of a submarine 34 adapted to launch a projectile 36 therefrom in accordance with an alternative embodiment of the launching technique of the present invention. As shown in FIG. 4, the submarine 34 is submerged below the surface 38 of a body of water 40 and is in motion in a direction Fl substantially parallel thereto. The submarine 34 includes a launch tube 42 which is linked by a passageway 44 to an exhaust tube 46. The projectile 36 includes an engine for propelling the projectile 36 from the tube 42. The projectile engine expels exhaust gases from a nozzle 48, thus creating a pressurized plume below the projectile 36. This gaseous plume is then forced through the passageway 44 and the exhaust tube 46 and is injected as a jet plume P into the water 40. Again, the jet plume P shields the projectile 36 from the lateral hydrodynamic force exerted by the water 40.

The tubes 42 and 46 are separated by a distance D sufficiently small such that upon launch the projectile 36 will be immediately proximate the jet plume P. As discussed above, the path of the plume P from the exhaust tube 46 may be estimated using equation [1]. The tubes 42 and 46 are in linear alignment such that a horizontal axis passing through the center of each is substantially parallel to the direction of the flow field vector $V_\infty$. That is, the tubes 42 and 46 are aligned in the direction Fl traveled by the submarine 34. In this manner, the jet plume P is effectively interposed as a flexible barrier between the projectile 36 and the water flowing laterally relative thereto. It is noted that a delay typically exists between actuation of the projectile engines and vertical motion of the projectile 36 within the tube 42. It is anticipated that this delay will be of sufficient duration to allow the jet plume P to be expelled prior to emergence of the projectile 36 from the tube 42. In accordance with the present teachings, valves and associated controls (not shown) may be incorporated into the design to regulate the rate of expulsion of the plume relative to the emergence of the projectile for optimum performance.

While the present invention has been described herein with reference to a particular embodiment, it is understood that the invention is not limited thereto. The teachings of this invention may be utilized by one having ordinary skill in the art to make modifications within the scope thereof. For example, the technique of the present invention could be utilized aboard surface ships to ameliorate the lateral aerodynamic force exerted upon projectiles launched thereby. In addition, in terrestrial applications the inventive launching technique could be employed to shield a projectile undergoing launch from high winds. In such terrestrial applications a mobile source of compressed air could be positioned so as to create a jet to suitably deflect the wind from the projectile. Similarly, the inventive launching technique could be implemented in aircraft disposed to launch projectiles in a direction having a component normal to the surrounding aerodynamic flow. The invention is further not limited to jets consisting of any particular gaseous or fluid media, nor to applications wherein a projectile is housed within a tube structure prior to launch.

It is therefore contemplated by the appended claims cover any and all such modifications.

Accordingly,

What is claimed is:

1. A method for launching a projectile from a launch point into a medium in motion relative to said projectile, comprising the steps of:

a) injecting a pressurized jet into said medium upstream from the launch point to said projectile and b) propelling said projectile from said launch point into said medium proximate to said injected jet.

2. The method of claim 1 wherein said relative motion is of a first velocity and in a first direction substantially parallel to a flow axis extending between said jet and said launch point, and wherein said step of injecting further includes the step of adjusting the velocity of said jet in response to said fist velocity.

3. An apparatus for launching a missile from a launch point on a vehicle submerged in a fluid body and in motion in a first direction therethrough, said apparatus comprising:

means for injecting a pressurized jet into said fluid body upstream from the launch point of said projectile and means for propelling said missile from said launch point into said fluid body proximate to said injected jet.

4. The apparatus of claim 3 wherein said means for injecting includes a first tube structure and wherein said means for propelling includes a second tube structure.

5. The apparatus of claim 4 wherein said means for injecting includes a pumping mechanism for forcing a pressurized stream of fluid into said first tube structure, said first tube structure being in fluid communication with said fluid body.

6. The apparatus of claim 4 wherein said first and second tube structures are in fluid communication.

7. The apparatus of claim 6 wherein said means for propelling includes an engine coupled to said projectile, said engine being disposed to expel exhaust gases.

8. The apparatus of claim 7 wherein said missile is positioned in said second tube structure such that said exhaust gases are forced into said first tube structure thereby forming said pressurized jet.

* * * * *